United States Patent [19]

Berchem et al.

[11] Patent Number: 4,712,321

[45] Date of Patent: Dec. 15, 1987

[54] EXCAVATOR TOOTH FOR EARTH MOVING EQUIPMENT

[75] Inventors: Rütger Berchem, Gelsenkirchen; Georg Prokscha, Recklinghausen, both of Fed. Rep. of Germany

[73] Assignee: Berchem & Schaberg GmbH, Gelsenkirchen, Fed. Rep. of Germany

[21] Appl. No.: 924,617

[22] Filed: Oct. 29, 1986

[30] Foreign Application Priority Data

Oct. 29, 1985 [DE] Fed. Rep. of Germany ..... 3538355

[51] Int. Cl.[4] ..... E02F 9/28

[52] U.S. Cl. ..... 37/142 R; 37/141 T

[58] Field of Search ..... 37/142 R, 141 T, 142 A; 299/91, 92, 93

[56] References Cited

U.S. PATENT DOCUMENTS

| | | | |
|---|---|---|---|
| 817,512 | 4/1906 | Palmer | 37/142 R |
| 1,776,676 | 9/1930 | Bauer | 37/142 R |
| 1,966,401 | 7/1934 | Andren | 411/507 |
| 3,397,012 | 8/1968 | Krekeler | 299/92 |

*Primary Examiner*—Edgar S. Burr
*Assistant Examiner*—James A. Lisehora
*Attorney, Agent, or Firm*—Karl F. Ross; Herbert Dubno

[57] ABSTRACT

The digging tool for loosening and loading comprises an adapter attached to a tool support and a tooth attachable to the adapter. The tooth has a tooth bottom portion and a tooth peak which are independent separate components. The tooth peak has a supporting face and is mounted with that supporting face on a complementary supporting surface of the bottom portion of the tooth. The tooth peak has a mounting pin which is guided through a hole surrounded by the supporting surface of the bottom portion and is deformed into a rivet attaching the tooth peak and the tooth bottom portion.

1 Claim, 2 Drawing Figures

EXCAVATOR TOOTH FOR EARTH MOVING EQUIPMENT

CROSS REFERENCE TO RELATED APPLICATION

This application is related to the copending application Ser. No. 701,580, filed 14 Feb. 1985, Ser. No. 821,997, filed 24 Jan. 1986 and Ser. No. 901,269, filed 27 Aug. 1986.

FIELD OF THE INVENTION

Our present invention relates to an earth loosening and loading tooth for an excavator such as a dredge, suction-head dredge, wheel excavator or trench digging machine, a shovel or bucket loader, a drag-line excavator or the like.

BACKGROUND OF THE INVENTION

A tool for earth loosening and loading can comprise an adapter attached to a tool support and a tooth mountable on the adapter. This tooth can have a bottom portion and a tooth peak formed as independent components of the tool, the tooth peak having a supporting face which engages on a complementary supporting surface of the bottom portion. The tooth peak and the tooth lower portion can be made from different materials.

Advantageously the took peak is composed of a wear resistant material and the tooth bottom portion is made from a tough material adapted to withstand bending forces.

In the digging tool of German Utility Model G No. 85 08 332 the tooth peak is fitted on a connector pin of the tooth bottom portion and pinned to or otherwise fastened with this connector pin. The pin or wedge attachment is found in a region which is subject to wear on the tooth peak. Striking and splintering forces act directly on the wedge attachment during digging. Abrasion also, leads quickly to a weakening of the tooth peak near the wedge joint. A premature breakdown is often likely to occur.

OBJECTS OF THE INVENTION

It is an object of our invention to provide an improved digging or excavating tool for earth loosening and loading, particularly for use in a dredge, wheel loader or a like excavator which will obviate the drawback described.

It is also an object of our invention to provide an improved digging tool for loosening and loading in which a reliable attachment between the tooth peak and the tooth bottom portion is attained even when the tooth peak is subjected to substantial breaking and slicing forces when in use.

SUMMARY OF THE INVENTION

These objects and others which will become more readily apparent hereinafter are attained in accordance with our invention in a tool for earth loosening and loading, i.e. an excavator tooth, comprising an adapter attached to a tool support and a tooth tip mountable on the adapter. This tooth has a bottom portion and a tooth peak formed as independent components of the tool, the tooth peak having a supporting face which engages on a complementary supporting surface of the bottom portion. The tooth peak and the tooth lower portion can be made from different materials. Advantageously the tooth peak is composed of a wear resistant material and tooth bottom portion or base is made from a tough material suitable for withstanding bending forces.

According to our invention the tooth peak has an axially extending mounting pin which is guided through a hole surrounded by the supporting surface of the bottom portion and is deformed, i.e. coined into a rivet or rivet head attaching the tooth peak and the bottom portion.

Also according to our invention an undetachable attachment of the tooth peak to the tooth bottom portion is made. The rivet connection is easily made and can be made at the home site with simple means. Also the exchange of worn tooth peaks is possible in the standard way at the construction site. The worn tooth peak is quickly separated by a fast operating cutting tool insertable between the supporting surface and the supporting face.

Subsequently the rivet pin is pressed out with the help of a hydraulic mechanism. This is particularly easy when, according to a preferred embodiment of our invention, the hole in the tooth lower portion has a conically widening shape directed interiorly. Although the tooth peak and the tooth bottom portion are attached to each other rigidly by riveting, it has been shown that it is advantageous according to our invention to resist especially strong bending forces, that the supporting surface and the supporting face be provided with antirotation locking elements such as a plurality of tongues and grooves.

An advantage of the invention is that between the tooth peak and the tooth bottom portion a very secure attachment is made which results in no additional stress from the exterior. Attaching and releasing the attachment is possible with simple means and can be done at the construction site. The attaching device of the tooth peak on the bottom portion leads to scarcely any stress which might alter the shape of the tooth peak. Its geometry is adaptable to the tool purpose. Another great advantage is that the attaching pin can be used independently of the geometry of the tooth peak as a standard structual component.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
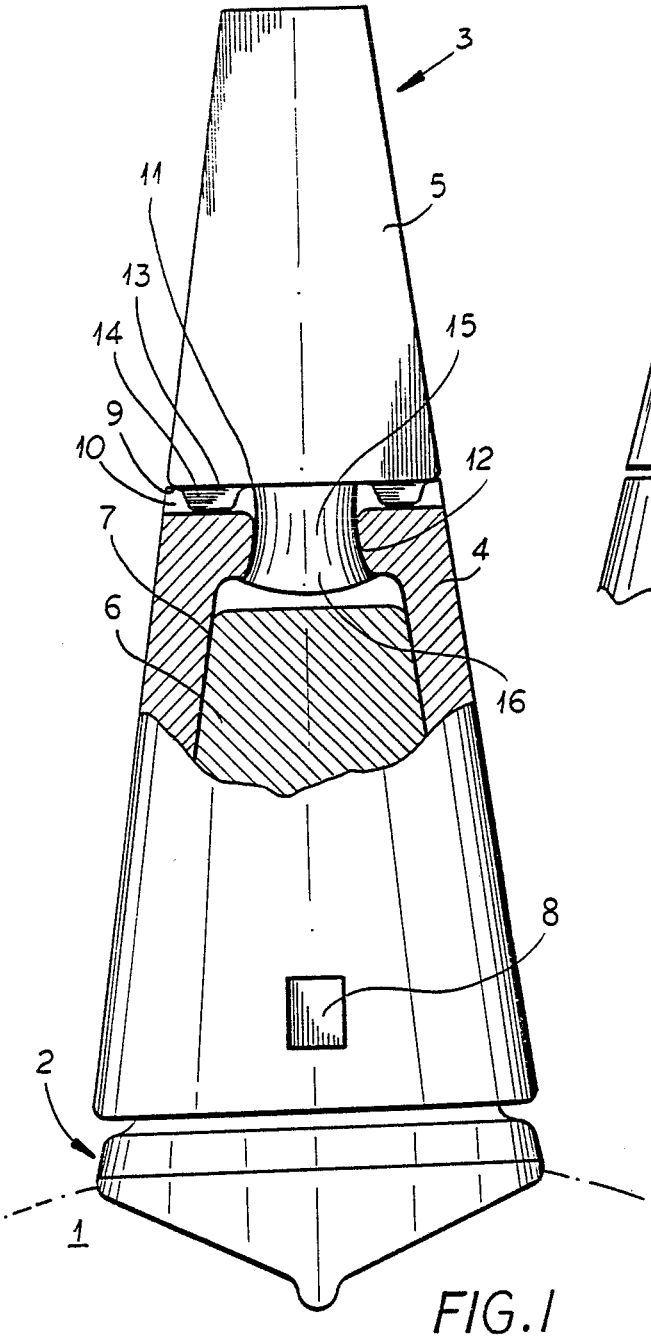
FIG. 1 is a side elevational view, broken away along a longitudinal section of an excavating tool for a dredge, a suction-head dredge, a wheel loader, a bucket or the like according to our invention.
Figure 2:
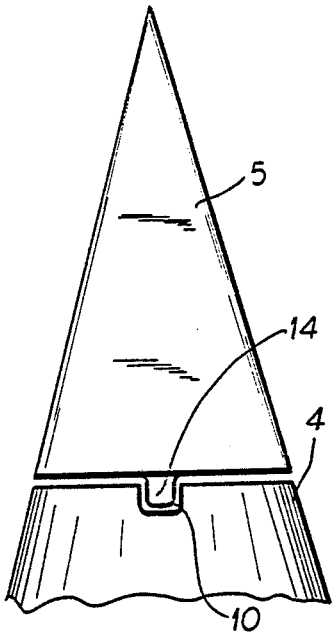
FIG. 2 is a fragmentary side elevational view thereof.

The digging tooth for loosening and loading shown in the drawing comprises an adapter 2 attached to the tool 1 and a tooth 3 mountable on the adapter 2 with a bottom portion or base 4 and a tooth peak 5. The adapter 2 has an adapter head 6 which fastens into an adapter head receptacle 7 of the bottom portion 4. The adapter 2 and the tooth 3 are attached to each other by being locked together, for example by a fitting pin or by a wedge attachment 8.

The bottom portion 4 and the tooth peak 5 are independent. The bottom portion 4 has on its front side a supporting surface 9 in which grooves 10 for receiving the fitting tongues 14 are embedded. Further a hold 11 is formed in the supporting surface 9 that has a conical widening 12 opening in the direction of the adapter head receptacle 7. The tooth peak 5 has on its bottom side a supporting face 13 complementing the supporting surface 9, a locking element which is in this case the fitting tongue 14 and a mounting pin 16. The toothed peak 5 is mounted on the supporting surface of the tooth bottom portion 4 with the supporting face 13, whereby the fitting tongues 14 engage in the grooves 10.

The mounting pin 15 is guided through the hole 11 and is deformed (i.e. coined) into a rivet with rivet head 16. In this way a rigid attachment is made between the toothed peak 5 and the bottom portion 4.

To fix the rivet, in place the mounting pin 15 is heated and the toothed peak 5 placed in the tool holder with the mounting pin 15 directed upwardly. Then the deformation of the mounting pin 15 is effected by riveting and a heavy sledge hammer.

When the mounting pin 15 cools, a shrinking occurs which leads to an increased pressure between the bottom portion 4 and tooth peak 5 and ensures rigid attachment without play.

We claim:

1. A tool for loosening and loading for a dredger, a suction strainer dredger, a wheel loader, a shovel loader or the like comprising:

an adapter attached at an end thereof to a tool support;

a tooth attachable to said adapter, said tooth comprising a bottom portion and a tooth peak formed as independent components of said tool, said tooth peak having a supporting face which engages on a complementary supporting surface of said bottom portion, said bottom portion having a hole therein leading to an interior area;

a mounting pin which is guided through said hole, said hole being surrounded by said supporting surface of said bottom portion, said pin being deformed into a rivet attaching said tooth peak and said bottom portion, said hole having a conical widening directed interiorly and said rivet form-fitting said conical widening; and a plurality of complementary rotation-preventing locking elements provided on said supporting surface and said supporting face.

* * * * *